United States Patent [19]

Swanson

[11] 4,365,710

[45] Dec. 28, 1982

[54] UNITIZED PALLETS

[75] Inventor: Elmer G. Swanson, Salinas, Calif.

[73] Assignee: Champion International Corporation, Stamford, Conn.

[21] Appl. No.: 958,280

[22] Filed: Nov. 6, 1978

Related U.S. Application Data

[63] Continuation of Ser. No. 657,489, Feb. 12, 1976, abandoned.

[51] Int. Cl.[3] ..... B65D 19/38

[52] U.S. Cl. ..... 206/386; 108/51.3; 206/813

[58] Field of Search ..... 156/332, 334; 108/51 A, 108/56 A, 51.3, 53.1, 53.5; 206/386, 460, 813; 214/10.5 R; 229/51 WB; 260/28.5 AV; 428/484, 522–523; 248/205 A

[56] References Cited

U.S. PATENT DOCUMENTS

| | | | |
|---|---|---|---|
| 2,489,054 | 11/1949 | Sprolle | 108/51 A X |
| 2,744,624 | 5/1956 | Hoogstoel et al. | 206/591 X |
| 3,162,302 | 12/1964 | Champlin et al. | 206/460 X |
| 3,659,772 | 5/1972 | Dorsey et al. | 229/3.1 |
| 4,042,127 | 8/1977 | Brossia | 206/386 X |

FOREIGN PATENT DOCUMENTS

| | | | |
|---|---|---|---|
| 1217242 | 12/1959 | France | 206/386 |

*Primary Examiner*—Stephen Marcus
*Attorney, Agent, or Firm*—Evelyn M. Sommer

[57] ABSTRACT

Novel arrangement for creating a unitized pallet-load of wax treated paperboard containers whereby the containers have applied to at least one interfacing surface a predetermined pattern of an ethylene vinyl acetate copolymer synthetic resin blended with mineral oils and microcrystalline wax acting as an adhesive and then are stacked on the pallet in an array to reduce slippage between individual containers on the same level and adjacent containers on other levels of the stack.

3 Claims, 9 Drawing Figures

UNITIZED PALLETS

This is a continuation of application Ser. No. 657,489, filed Feb. 12, 1976, now abandoned.

BACKGROUND OF THE INVENTION

1. Field of the Invention

This relates to arrangements including adhesives for building pallet-loads of containers of the type made from wax-impregnated or treated paper or paperboard in order to reduce or eliminate the need for external restraints, such as straps, etc.

2. Description of the Prior Art

It is commonplace to ship fresh meats, vegetables, and fruits in paperboard containers packed in ice, the containers being made of a wax-impregnated material to impart strength in the presence of the moisture. The packing of these items sometimes takes place at temporary locations, often near the growing fields. Consequently, it is inconvenient to have automatic banding and strapping equipment on hand all the time. In addition this adds cost to the processor in terms of labor, equipment, and banding material.

It has been commonly known that palletized loads of boxes could be made unitary, or self-restraining, by applying to selected areas of containers an adhesive having greater bonding strength in shear than in tension, so the containers would resist normal slippage but be removable by pulling away from adjacent containers. *Food Industries,* July 1945, page 84. See also U.S. Pat. No. 3,322,323 to Greene et al, issued May 30, 1967; U.S. Pat. No. 2,578,583 to O'Brien, issued Dec. 11, 1951; and General Information Series 502 and 506 on Glued Loads issued by Freight Loss and Damage Prevention Bureau of the Association of American Railroads, 1946, reprinted 1966. (Copies are included for Examiner's convenience as they are now out of print.).

In spite of this previous work there is a need for a system which will function where wax-treated containers are used and are to be filled with or packed in ice or water.

SUMMARY OF THE INVENTION

An adhesive of the type having a base polymer of ethylene vinyl acetate copolymer, the blended synthetic resins being modified with mineral oils and microcrystalline wax is used to adhere adjacent wax treated containers in an array on a pallet or base.

DETAILED DESCRIPTION OF THE PREFERRED EMBODIMENT

The use of wax treated paper, paperboard, or corrugated paperboard for shipping articles to be packed in ice or having moisture content and requiring refrigeration is commonplace. Labor and material costs greatly add to the packaging costs where banding or strapping of palletized loads is done to hold the loads during transit and storage.

Figure 1:
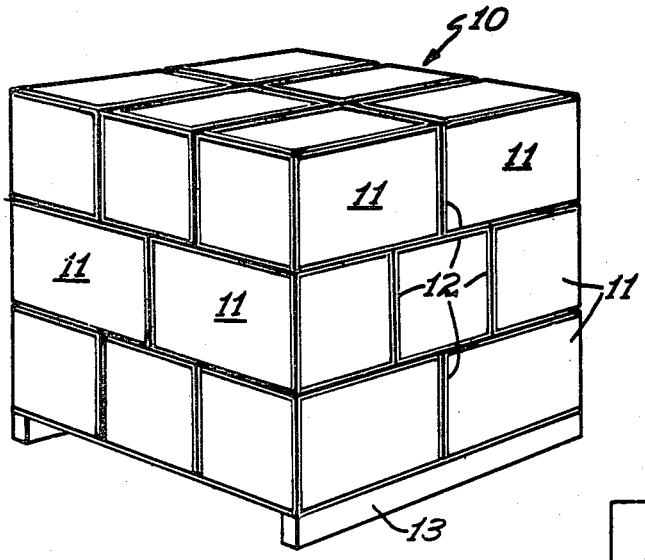
FIG. 1 is a perspective view of a typical assembled pallet load of containers embodying the present invention.

The exact configuration of the load is not important and the stacking order will depend on the dimensions of the carton as is well known in the art. A typical interlocking stack 10 is shown in FIG. 1 in which a number of rectangular containers 11 are arranged in successive layers so that the seam 12 created by adjacent containers does not coincide with the seam 12 on the next layer or tier.

Figure 9:
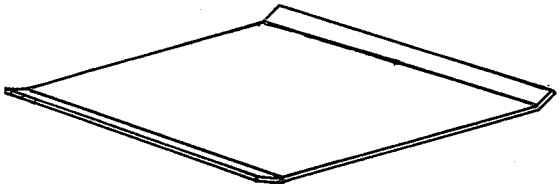
FIG. 9 shows a perspective view of a typical pull-sheet which could be used as a support for a typical pallet load of containers embodying the present invention.

The stack 10 is built upon a pallet or skid 13. It should be understood that this invention has equal application where single layer pull sheets such as shown in FIG. 9 are used instead of wooden pallets. Ideally the type of support used should be of a material to which the adhesive which is used will adhere.

The term "containers" should be broadly construed to include such other forms as bags which may be stacked and is not intended to be restricted to closed rectangular paperboard containers.

Each carton 11 is loaded and sealed before it is joined to the stack 10 has applied to its surface an adhesive of the type described below, which is one that will create a bond between adjacent layers of wax coated paperboard and which bond will have significantly greater strength in shear than in tension so that the adjacent surfaces will resist slippage and vibration but allow the cartons 11 to be torn away from each other in a direction normal to the surfaces, or in tension.

Packing of fruit and vegetables is frequently done in buildings adjacent to the fields where sorting and washing is also carried out. The cartons are then sealed and processed along a system similar to that shown in FIG. 4. The cartons 11 move along a conveyor 14 to the area where they are to be palletized. At the end of the conveyor 14, or positioned at right angles to it along its length is a means 15 for applying a predetermined amount of the adhesive to at least the bottom side of the cartons 11.

Figure 2:
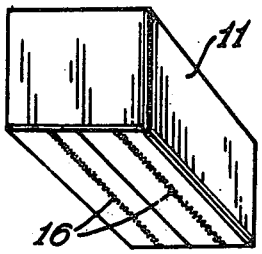
FIG. 2 is a perspective view showing the bottom side of a wax-treated container such as should be used to make up the load shown in FIG. 1 illustrating one embodiment of glue pattern which could be employed.
Figure 3:
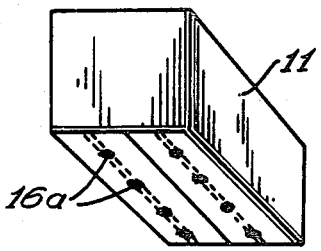
FIG. 3 is an alternate embodiment showing adhesive applied in a dot pattern by means of a special wheel.

The pattern of application may vary but one successful arrangement is shown in FIG. 2 as two strips or lines 16 of adhesive extending along the two outer folded flaps of the carton 11. The applicator wheel, to be described later, may also be formed with recesses which have a "dot" pattern as seen in FIG. 3. This pattern has intermittant dots or gobs 16A of adhesive which reduce the problem of adjacent surfaces not being absolutely flush and therefore obtaining in complete adherence where a thin layer of adhesive is used.

The cartons 11 with the adhesive pattern 16 thereon are then stacked, first on the pallet or sheet 13, to which they adhere, and then on one another in whatever array is desired. It is contemplated that adhesive may be applied to the interfacing sides of the cartons as well to improve lateral stability although it is not necessary in each case.

Figure 5:
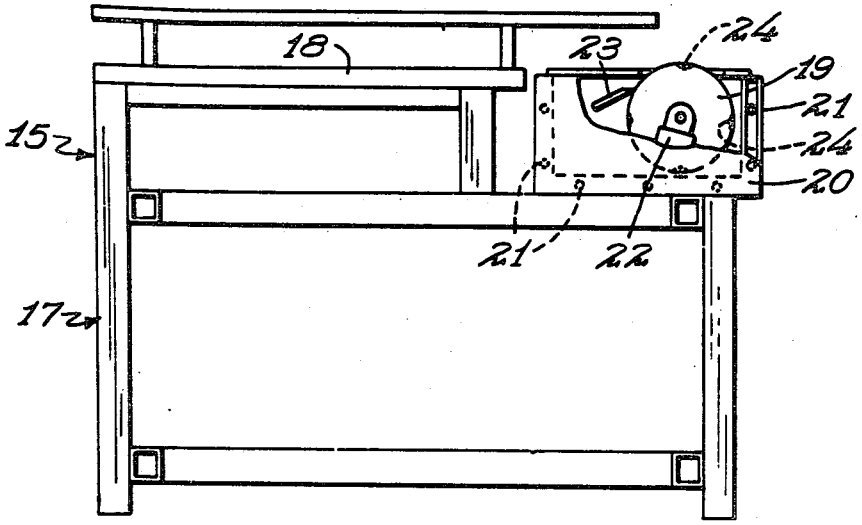
FIG. 5 is a side elevation view, partly in section, of the automatic glue applicator shown in FIG. 4.
Figure 6:
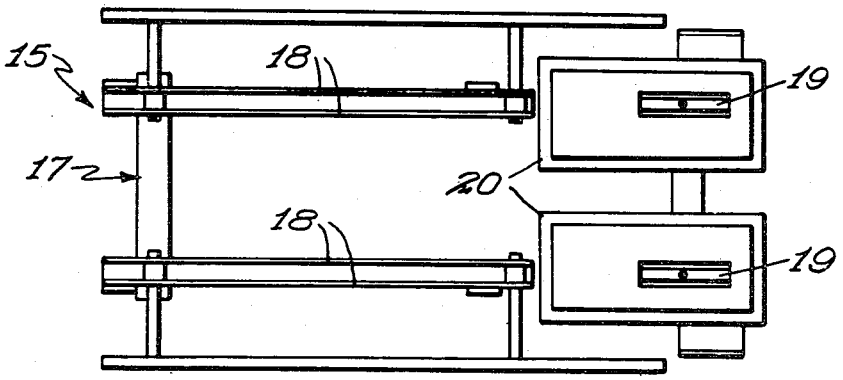
FIG. 6 is a top plan view of the glue applicator of FIG. 5.
Figure 7:
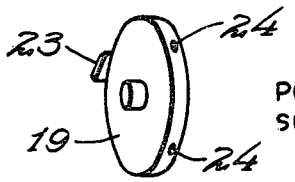
FIG. 7 shows an expanded perspective view of one of the glue wheels; and F

The glue applicator 15 includes a frame 17 which supports two skid rails 18 on which the cartons 11 are moved into position before the glue wheels 19. In the embodiment shown in FIGS. 5 and 6 there are two glue wheels and reservoir assemblies arranged to give the glue pattern shown in FIGS. 2 and 3. In the reservoir 20 there is an electrical resistance heater 21 which heats the adhesive at the appropriate temperature, generally about 225 F., in order to keep the viscosity at the desired level of about 2,000 cps, in the case of an adhesive such as that available from H. B. Fuller Company identified as F-5029. A bearing assembly 22 in the reservoir 20 supports the wheel 19 and allows it to rotate as the carton 11 is moved over it. This motion brings adhesive onto the surface of the wheel 19 where the excess is removed by a blade 23. As mentioned, the wheel may be fitted with recesses 24 spaced around the periphery to pick up and deposit additional amounts of adhesive. FIG. 7 is intended to show such an arrangement.

The reservoir 20 and bearings 22 are designed so that the bearing surfaces are immersed in the adhesive, and a thin layer of adhesive flows between the shaft and its mounting plate. The rheology of the adhesive is such that it provides lubrication for the bearing and avoids costly seals as in conventional bearing mechanisms which would otherwise be required since the wheels 19 must turn freely, even under heavy imposed carton weights.

The wheel 19 may also or alternatively be formed with a circumferential groove which would accentuate the height of the bead of adhesive. The same effect may be obtained by forming a groove in the doctor blade 23.

Figure 8:
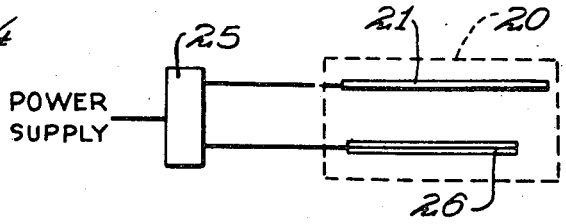
FIG. 8 shows schematically the heating and control system for the heater.

FIG. 8 schematically illustrates the heater arrangement which may be of any general design and here includes a power supply which delivers energy to a control system 25 which may be set to maintain a given temperature. The thermostat 26 signals the control 25 when the temperature falls below that which is desired and the control 25 then directs power to the heater 21 which adds heat to the reservoir 20 until the temperature is reached, the thermostat 26 and control 25 then cutting off the power.

The adhesive employed should be one having greater bonding strength in shear than in tension in the range of temperatures encountered during storage and transit. One such adhesive is a blend available from H. B. Fuller Company identified as F-5029. This is a blend of synthetic resins modified with the addition of mineral oils and microcrystalline wax, the base polymer being an ethylene vinyl acetate copolymer.

This particular adhesive has a weight of 8.05 lbs./gal. Other pertinent data considered desirable for the preferred embodiment are listed below:

Glass Transition Temperature: −24 to −20 degrees F.
Ring and Ball Softening Point: (ASTM E28-67) −150 to −159 degrees F.
Flash Point: 364 degrees F.
Ultimate tensile strength at 0 degrees F. and elongation of 175–200%: 900–1,000 psi (ASTM D 1320-67).
Shear strength @ −10 degrees F. (ASTM D-732-46 1961) 986 psi
(ASTM D217-T60 D5 Needle) Hardness
200 g./5 sec. Penetration:
0 degrees F.—0.5 mm.
32 degrees F.—3.5 mm.
75 degrees F.—14 mm.
Brookfield Thermosel Viscosity (Spindle SC4-21):
200 degrees F.—4,000 cps
225 degrees F.—2,000 cps
250 degrees F.—1,025 cps
275 degrees F.—500 cps
300 degrees F.—380 cps
325 degrees F.—270 cps
350 degrees F.—180 cps As mentioned, it has been found that applying the adhesive at about 225 degrees F. and a viscosity of near 2,000 cps is most desirable. The surfaces involved have been termed wax-treated paperboard, but within the context of this application that term is intended to include other fibrous substrates such as corrugated paperboard, solid fibre paperboard as used in manufacturing some types of containers, and in addition those fibrous materials used in containers such as bags, where the containers are of the type which are stacked on pallets. These fibrous substrates may be wax-treated which is intended to include wax-saturation such as may be obtained by dipping the whole surface in a pool of melted wax which gives what is referred to in the art as a "dry" surface, and also "wet" wax surfaces which are obtained by processes such as curtain coating with a hot-melt wax. It should be noted that some shippers and producers utilize more than one type of wax coating or substrate in the same facility and may even utilize special types of substrates such as wax emulsions which are applied to the corrugated board during its manufacture. The waxes which are involved are commonly blends of hydrocarbon petroleum parafin-type derivitives which may have additives to affect the bending characteristics in the final product or which have some other property relating to problems such as flaking of the wax on the final treated substrate.

Figure 4:
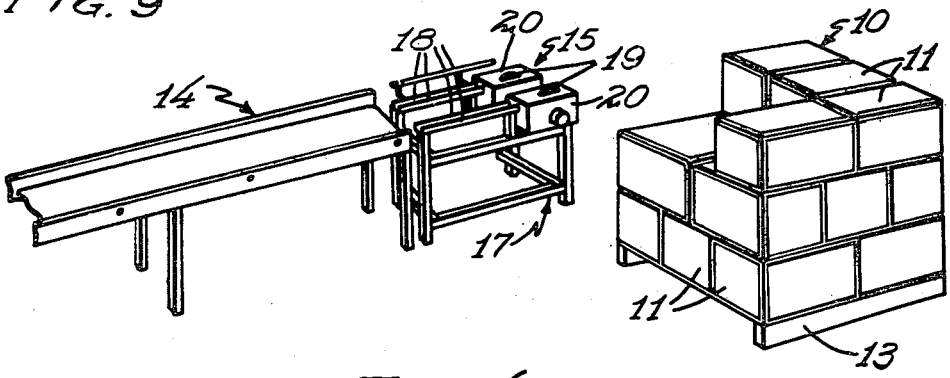
FIG. 4 shows equipment in a typical arrangement for building a pallet-load including an automatic glue applicator.

A typical process involving this technology is described and shown best in FIG. 4 wherein the containers which are to be stacked are brought to the area by a means such as a conveyor 14 and are presented to a means 15 which applies a predetermined amount of the adhesive which has been heated to the proper temperature as described in a predetermined pattern to at least the bottom side or surface of each container. The exact configuration may vary, and it may even be desirable to apply some adhesive to at least one side of the container to further improve lateral stacking strength and stability. With the adhesive on the bottom surface, the bottom layer of containers is adhered to the pallet or pull sheet and subsequent layers of containers are stacked in any common configuration with the adhesive causing bonding between layers as quickly as the adhesive cools.

The particular adhesive described is such that it has sufficient "open time", or time span after application but before it sets hard, that the cartons may be adjusted on the stack without undue haste or strain on the part of the person building the load.

I claim:

1. A unitized, self-sustaining pallet-load of containers made from a fibrous substrate which is wax-treated, comprising:

a support located at the bottom of said pallet-load;

at least one layer of said containers placed in a predetermined array on said support;

said containers each having a predetermined pattern application on at least the underside thereof of an adhesive of the type having a base polymer which is an ethylene vinyl acetate copolymer which is included in a blend of synthetic resins modified with mineral oils and microcrystalline wax.

2. The unitized load of claim 1, wherein said support is a pallet.

3. The unitized load of claim 1, wherein said support is a paperboard pull-sheet.

* * * * *